United States Patent [19]

van der Neer et al.

[11] Patent Number: 4,588,046

[45] Date of Patent: May 13, 1986

[54] DEVICE FOR LOWERING A LOAD ALONG A LINE

[75] Inventors: Abram P. van der Neer, Krimpen a/d Ijssel; Harm W. Holman, Doetinchem, both of Netherlands

[73] Assignee: van der Neer International B.V., Doesburg, Netherlands

[21] Appl. No.: 668,332

[22] Filed: Nov. 5, 1984

[30] Foreign Application Priority Data

Feb. 6, 1984 [NL] Netherlands ..... 8400368

[51] Int. Cl.[4] ..... A62B 1/14

[52] U.S. Cl. ..... 182/236; 182/231; 182/192

[58] Field of Search ..... 182/236, 5-7, 182/237, 231, 239, 71, 190-192, 234, 240, 72; 188/65.1-65.5

[56] References Cited

U.S. PATENT DOCUMENTS

| | | | |
|---|---|---|---|
| 383,432 | 5/1888 | Bernstein | 182/236 |
| 433,481 | 8/1890 | Mansfield | 188/65.5 |
| 590,016 | 9/1897 | Ellis | 182/237 |
| 646,635 | 4/1900 | Cabus | 182/237 |
| 778,743 | 12/1904 | Ewers | 188/65.5 |
| 1,172,753 | 2/1916 | Vescovi | 182/236 |
| 3,840,212 | 10/1974 | Latanision | 188/65.1 |

FOREIGN PATENT DOCUMENTS

| | | | |
|---|---|---|---|
| 651290 | 7/1964 | Belgium | 182/5 |
| 59699 | 9/1982 | European Pat. Off. | 182/234 |

*Primary Examiner*—Reinaldo P. Machado
*Assistant Examiner*—Alvin Chin-Shue
*Attorney, Agent, or Firm*—James E. Nilles

[57] ABSTRACT

Escape device comprising a holder 1 in which is guided a flat belt 23 and which accommodates at least one brake shoe 12*a* on which a force is exerted depending upon the weight of the load and which is directed toward the belt 23.

1 Claim, 2 Drawing Figures

DEVICE FOR LOWERING A LOAD ALONG A LINE

BACKGROUND OF THE INVENTION

This invention relates to a device for lowering a load along a line, comprising a holder with at least one retarding element acting on the line and activated by the weight of the load.

Such a device, particularly usable as an escape device for persons is known in itself from the published Dutch Patent Application No. 76,11229. In this known device the retarding element consists of a hallow spiral through which the cable goes; the retardation is brought about by friction between the cable and the inner surface of the spiral.

This known device has a number of drawbacks. Although in practice the complete device will undoubtedly be enclosed in a kind of bag the very real danger exists that the cable will be contaminated by dirt or grease so that the friction between cable and spiral decreases, resulting in very dangerous situations. Also when the cable is wound up compactly the whole takes a lot of space and is thus not suited to be taken along on travels. In this known device it is not possible to determine beforehand the friction between the spiral and the cable accurately so that in practice, to ensure that light persons and children can use the escape device safely the structure will be such that there is a low friction so that heavy persons must brake to lower the speed by gripping the cable with one hand; then, too, the lowering speed can easily become much too high. Unconscious persons cannot be brought into safety with this known device. When there is a twist or knot in the cable—which can easily happen—the device is useless.

SUMMARY OF THE INVENTION

The invention aims to provide an escape device which always operates surely and reliably and has a simple structure, in which the line is protected and of which the safe operation is ensured, even after a long period of no use.

These aims are realised in that the line is a flat belt, and the retarding element is formed by at least one brake shoe on which a force is exerted which depends on the weight of the load and which is directed toward the belt.

By a suitable choice of material of the belt and the brake shoe, which is in practice always possible, it is ensured that the speed which with the load is lowered is independent of the weight of the load within a large range so that the device can be used with the same security by heavy as well as by light persons, if necessary by several persons together. The belt can be heat-resistant so that escape from burning buildings is possible.

A great length of the belt can be accommodated in a relatively small space so that a device which is suited for escapes from high buildings can be made with small dimensions, as a result it is possible to take the device along when travelling. When the belt leaves the device at the side on which the load is carried the distance along which a load can be lowered is practically unlimited.

There is, contrary to the known device, no physical force necessary to control the lowering speed and the use of the device does not necessitate, contrary to the known device, any insight in that way in which it operates; unconscious people can be brought to safety without any danger using the novel device.

In a preferred embodiment the present device comprises a lever which has a first end acting on the brake and has its point of rotation eccentric to the point where the first end acts upon the brake and whose second end is acted upon by spring tension for tensioning the brake shoe, on the one hand, and can also be loaded in the same direction by the load, to be lowered.

Preferably the device comprises two brake shoes located on either side of the belt, each hinged to the end of a tilting lever whose point of rotation is located in the holder and whose other end is linked to a pull rod which runs essentially parallel to the contact surface of the brake shoes and is acted upon by a spring also acting on the holder, while the respective other ends of the pull rods are linked to an external point of application.

Preferably the device comprises a belt reel fitted between the two pull rods and located in the holder; in a preferred embodiment this reel is provided in a detachable cassette.

There are preferably provided two belt guides on either side of the brake shoe surface between the brake shoes and the belt reel, while in a preferred embodiment the springs are formed by compressing springs fitted around the pull rods, acting between a stop connected to a pull rod and a stop on the holder.

The holder is preferably a housing which is made up of two halves, each with a flat wall part and upright side walls connected with each other while the pull rods are connected to a closing plate closing off the narrow bottom side thereof and carrying a grip.

SURVEY OF THE DRAWINGS

DESCRIPTION OF THE PREFERRED EMBODIMENTS

Figure 2:
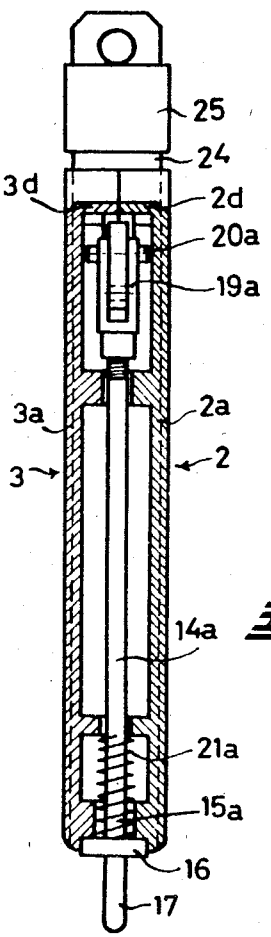
FIG. 2 is a cross section of the complete device.
Figure 1:
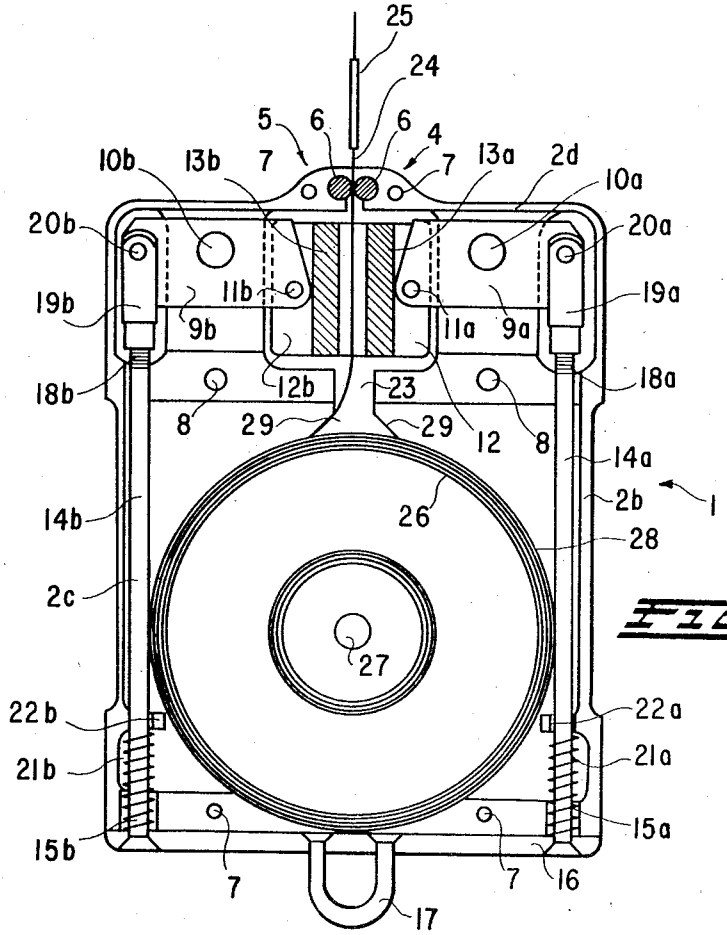
FIG. 1 is a front view of one half of the housing of a device according to the invention with the parts fitted therein, and thus with the front wall removed.

The device illustrated in FIG. 1, which is intended in particular as an easily transportable escape device, comprises a housing indicated in its entirety by reference numeral 1, and constructed from the halves 2 and 3, which connect with each other and each have a flat bottom 2*a* and 3*a* respectively, upright sides 2*b*, 2*c* and 3*b*, 3*c* respectively which are connected together, and narrow upright top sides 2*d* and 3*d* respectively. The latter have protuberances 4 and 5 respectively, containing sealing elements 6 between which the belt—to be described in greater detail—is guided. The two halves of the housing are fixed in relation to one another by means of dowels 7 and suitable fastening points 8.

The housing contains two levers 9*a*, 9*b*, each mounted to rotate about a journal 10*a*, 10*b*, fixed to housing half 2. Each of the levers 9*a*, 9*b* is hinged at 11*a* and 11*b* respectively to a flange 12*a* and 12*b* respectively of a brake shoe 13*a* and 13*b* respectively. Since the points of rotation 10*a* and 10*b* are eccentric in relation to the points of rotation 11*a* and 11*b*, when downward forces are exerted on the other ends of the levers 9*a*, 9*b* (as shown), the brake shoes will be pressed toward each other.

These forces are exerted by means of pull rods 14*a*, 14*b*, which are fixed by their bottom end 15*a*, 15*b* to the closing plate 16 which carries the grip 17 and which can move up and down relative to the housing through a limited distance. The top end 18*a* and 18*b* of each pull rod, which is provided with screwthread, is screwed into the bottom end of a draw piece 19*a*, 19*b*, which is attached via hinge pin 20*a*, 20*b* to the outside end of the lever 9*a*, 9*b*. A compression spring 21*a*, 21*b* surrounding each pull rod 14*a*, 14*b* is fitted between a stop 22*a*, 22*b* fixed on the housing and the closing plate 16.

The pull belt 23 running between the brake blocks 13*a*, 13*b* projects with its free end 24 from the housing and has an eye 25, the belt is wound up on the reel 26, whose axis of rotation 27 is mounted in housing half 2 and is located in a replaceable cassette 28. Suitable belt conducting edges 29 are located between the brake shoes 13*a*, 13*b* and the cassette 28.

The device operates as follows:

By means of the springs 21*a*, 21*b*, even in the rest position a certain force is exerted on the belt 23 by the brake shoes 13*a*, 13*b*. When the device is in use, either the belt end 25 or the grip 17 is fixed; if the former is the case, the load—i.e. the person who wishes to reach safety—hangs on the grip 17, and in the latter case the load hangs on the belt end 25. During the descent the weight is distributed uniformly over the two pull rods 14*a*, 14*b*, which transfer the force exerted to the outside ends of the levers 9*a*, 9*b*, as a result of which the points of rotation 11*a*, 11*b* exert a pressure force on the belt 23 which is in proportion to the weight of the load. In consequence, the load will move downwards at virtually constant speed along the belt 23 within wide limits irrespective of the weight of the load.

Of course, it is also possible to have an embodiment in which the belt is not accommodated in the housing in the wound up state, but is hanging down in an unrolled state. In that case, a suitable recess is provided in the closing plate 16.

Other modifications are also possible. The brake action exerted is, of course, dependent on the ratio of the distances between the points of rotation 10*a* and 10*b*, on the one hand, and the points of rotation 11*a* and 11*b*, and 20*a* and 20*b*, respectively on the other hand. By making this ratio adjustable, which is possible, for example, by making the points 20*a* and 20*b* movable—for instance by a suitable slotted hole construction—the retardation achieved can be adjusted.

What is claimed is:

1. A device for controlledly lowering a load, of the type comprising a load supporting belt having one end portion at which there is a first eye, and a housing wherein the remainder of the belt, in an unextended looped condition, is normally enclosed, said housing having front and rear walls at edgewise opposite sides of the belt, opposite top and bottom ends, and opposite side walls, and having an opening in its top end through which said end portion of the belt extends and through which the remainder of the belt is withdrawn upwardly from the housing under opposing forces exerted at said first eye and at a second eye at the bottom end of the housing, said device being characterized by:

A. said housing having in its interior a defined zone which is spaced inwardly from its said ends and from its said side walls and wherein said remainder of the belt is normally confined;

B. a pair of levers in said housing, each having an inner end and an outer end, (1) each said lever being medially fulcrummed, for up and down swinging of its ends, upon a pivot which is fixed in the housing inwardly adjacent to the top end thereof and which is spaced inwardly a substantial distance from one of said side walls and a greater distance from the other side wall, (2) each said lever having its outer end adjacent to the side wall that is nearer its pivot and having its inner end opposingly adjacent to the inner end of the other lever;

C. A pair of brake shoes, one for each said lever, each said brake shoe (1) having a belt engaging surface that opposes and is adjacent to the belt engaging surface on the other brake shoe and (2) having a pivotal connection to the inner end of its lever whereby upward swinging of the inner ends of said levers clampwise engages the brake shoes with the belt;

D. a pair of tension rods, one for each of said levers, each said tension rod being inwardly adjacent to a side wall of the housing and having at an upper end thereof a pivotal connection with the outer end of its lever;

E. a transverse member at the bottom end of the housing to which the lower end of each said tension rod is connected, said transverse member (1) being confined to limited up and down motion relative to the housing and (2) having said second eye fixed thereto so that downward force on said second eye, transmitted through the tension rods and the levers, applies belt clamping force to the brake shoes; and F. a compression spring surrounding each tension rod and reacting between it and the housing to bias the tension rod downwardly, said springs thus maintaining belt clamping force on the brake shoes when no load is applied to said second eye.

* * * * *